United States Patent [19]

Hart

[11] 3,930,767

[45] Jan. 6, 1976

[54] CIRCULAR ROTOR SIDE SEAL FOR ROTARY MACHINES

[75] Inventor: Jack A. Hart, Mount Clemens, Mich.

[73] Assignee: General Motors Corporation, Detroit, Mich.

[22] Filed: July 16, 1974

[21] Appl. No.: 488,956

[52] U.S. Cl. ..... 418/113; 418/142

[51] Int. Cl.[2] ..... F01C 19/04; F01C 19/08; F04C 27/00

[58] Field of Search ..... 418/113, 120–124, 418/142

[56] References Cited

UNITED STATES PATENTS

| | | | |
|---|---|---|---|
| 3,193,188 | 7/1965 | Bentele | 418/142 |
| 3,251,541 | 5/1966 | Paschke | 418/124 |
| 3,827,835 | 8/1974 | Higuchi et al. | 418/142 |
| 3,853,439 | 12/1974 | Jones | 418/121 |

*Primary Examiner*—John J. Vrablik
*Attorney, Agent, or Firm*—Charles R. Engle

[57] ABSTRACT

A multi-apex rotary combustion engine rotor has simplified side face circular compression seals mounted in circular grooves passing across the face of corner button seals. The button seals are of a substantially enlarged diameter permitting machining of the circular seal grooves in the rotor side face.

3 Claims, 5 Drawing Figures

CIRCULAR ROTOR SIDE SEAL FOR ROTARY MACHINES

This invention relates to rotary combustion engine rotor compression seals and more specifically to circular compression seals being mounted in rotor side face grooves passing through apex corner button seals.

In the presently commercial rotary engine having a two-lobe internal peripheral wall and a three-lobe substantially triangularly shaped rotor planetating relative to the two-lobe wall, a pair of gas seals are mounted in grooves machined adjacent the three rotor peripheral sides connecting with corner button seals at each rotor apex. This arrangement necessarily requires several separate machining operations as the groove adjacent each rotor peripheral face is in the form of a separate discontinuous arc. Accordingly, it is a purpose of this invention to simplify the structure and the manufacturing process of rotor side face mounted compression seal assemblies by making them circular in form. Obviously the forming of a circular seal groove in a rotor side face can be accomplished by a single machining operation as compared to the aforementioned three separate machining operations required when the seal is substantially parallel to the rotor peripheral faces in the form of a discontinuous arc. Likewise, a single split sealing ring which can be installed in a single assembly step can be accommodated in the continuous circular groove instead of a three step operation required when three separate seal segments are used in accordance with the present practice.

Since the maximum radius of a singular compression gas seal is limited by the radius at a point midway between the rotor apices, the gas seals are located substantially radially inwardly from the apex seals. In order to provide the necessary seal between the compression seals and the apex seals it is necessary to enlarge the corner button seals so that they extend a distance sufficient to connect the apex seal with a side face mounted compression seal. In a preferred form, the button seals are of an enlarged circular form and the circular compression seal grooves pass through the button seals in completing their circular path. The face of the button seals can be relieved in their central portions so as to reduce the amount of force required for sealing them against the engine housing end walls. Small cylindrical plug seals are provided in apertures in the bottom of the circular compression seal grooves and are spring biased into continuous engagement with the bottom of the compression seal assemblies. This arrangement prevents flow of pressurized gases through the open passage that normally exists underneath the seal assemblies.

An object of the present invention is the provision of a simplified compression seal assembly for a rotary internal combustion engine.

Another object of the present invention is the provision of a rotary engine rotor side face compression seal assembly having a circular form fitting into mating side face grooves which in part encompass arcuate grooves machined in enlarged apex corner button seals.

A further object of the present invention is the provision of a rotor side face compression seal, circular in form, for a rotary internal combustion engine and including circular grooves containing split circular sealing rings passing through enlarged cylindrical corner button seals, the button seals being relieved in their central portions reducing the force necessary to engage them with engine housing end walls, the button seals containing spring biased plug seals engaging the underneath side of the circular seal assembly closing a normally open passage beneath the rings in the circular grooves.

The novel features which I believe to be characteristic of my invention are set forth with particularity in the appended claims. My invention itself, however, both as to its organization and method of operation, may best be understood by reference to the following description taken in connection with the accompanying drawings in which:

Figure 1:
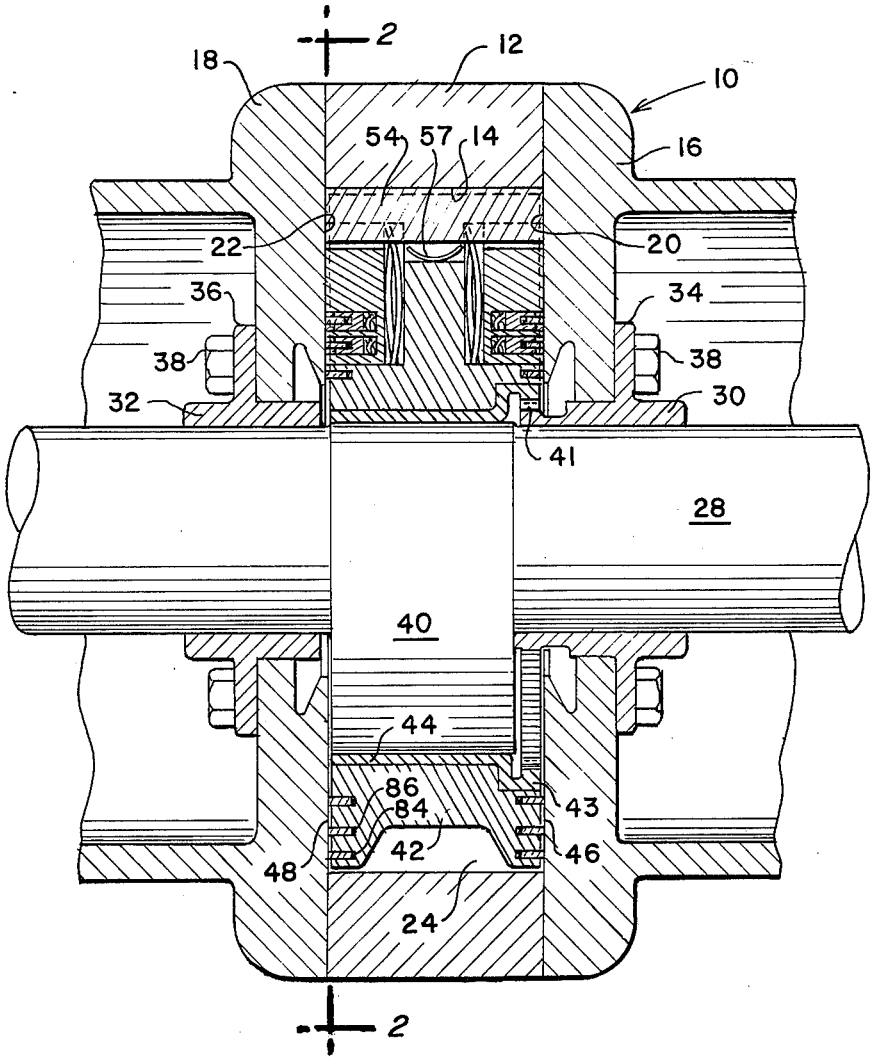
FIG. 1 is a longitudinal view, with parts in section, of a rotary engine having circular compression seals constructed in accordance with the present invention.
Figure 2:
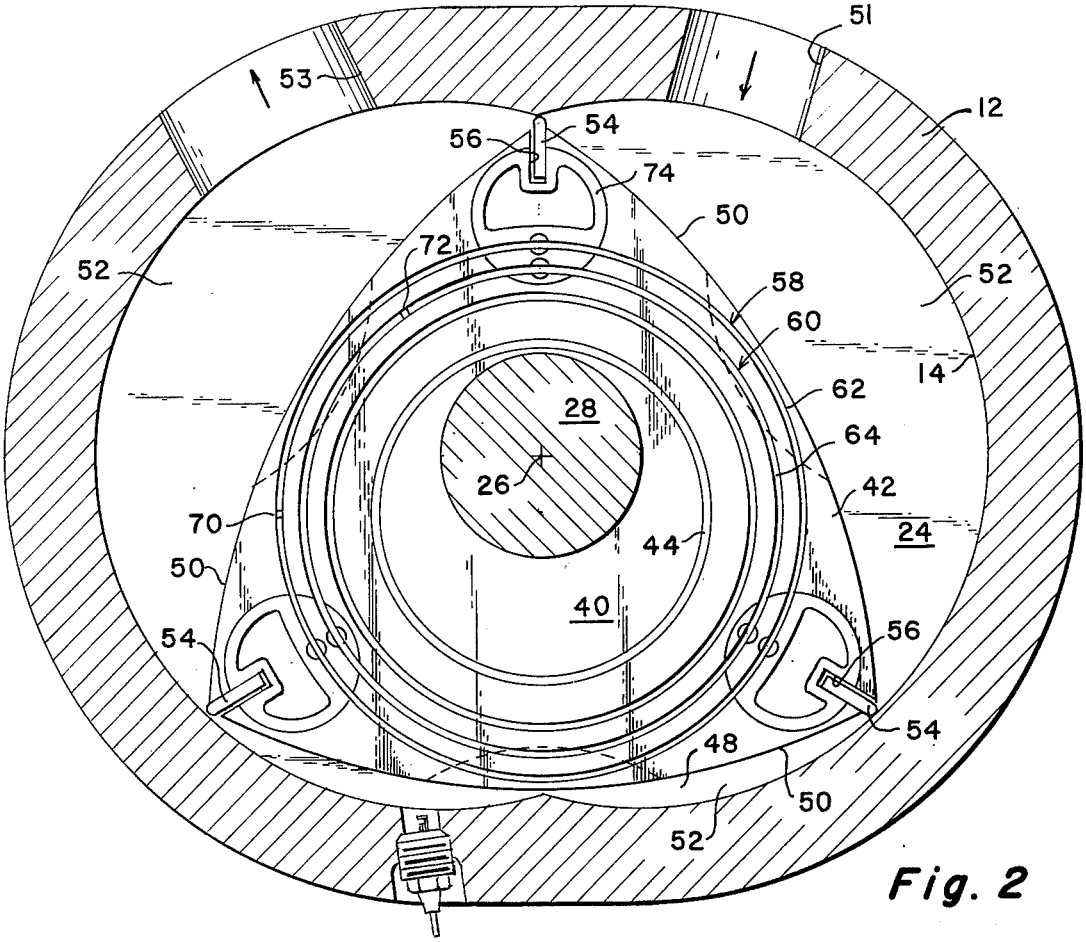
FIG. 2 is a view taken along line 2—2 in FIG. 1 showing one rotor side having circular compression seals mounted therein.

The present invention concerns improved rotor side face compression seals for use in rotary machines having particular application in rotary internal combustion engines of the planetary type shown in FIGS. 1 and 2. The rotary engine shown in FIG. 1 includes a housing 10, which in a single rotary arrangement as shown, has three basic elements; namely, a rotor housing 12 defining an inwardly facing peripheral wall 14 and a pair of end housings 16 and 18 having parallel oppositely facing spaced inner end walls 20 and 22, respectively. The housing parts are secured together by bolts, not shown, and the inner housing walls 14, 20 and 22 define a cavity 24. As shown in FIG. 2, the cavity 24 defined by the peripheral wall 14 is a two-lobe cavity with a center axis at 26. A crankshaft 28 extends through the cavity and is rotatably supported in sleeve bearings 30 and 32 having flanges 34 and 36, respectively, secured to end housings 16 and 18 by a plurality of bolts 38. An eccentric 40 is provided on the crankshaft 28 for rotation within cavity 24 as is best illustrated in FIG. 1. A three-lobe rotor 42 having a sleeve bearing 44 secured therein is received upon the eccentric 40 so that the rotor is thereby supported in cavity 24 for rotation about the eccentric in the usual manner by virtue of engagement of phasing gears 41 and 43.

The rotor 42 has the general shape of an arcuate sided triangle with two parallel side faces 46 and 48 at right angles to the axis of crankshaft 28 which coincides with axis 26 of cavity 24. The side faces 46 and 48 face and rotate close to the end walls 20 and 22, respectively. The rotor 42 also has an outer peripheral wall including three arcuate outer faces 50 which face the peripheral wall 14 and cooperate therewith along with end walls 20 and 22 to define three variable volume working chambers 52. As shown in FIG. 2, the rotor housing 12 contains an intake port 51 and an exhaust port 53 permitting the variable volume working chambers 52 to receive, compress, expand and exhaust working fluids during operation of the rotary engine. Sealing of these working chambers 52 is effected by three apex seal assemblies including apex seals 54 mounted in respective axially extending grooves 56 at each rotor apex. The apex seals 54 continually engage the peripheral wall 14 by virtue of their being continuously biased outwardly of the grooves 56 by springs 57. In present practice the space between the rotor side faces 46 and 48 and end walls 20 and 22 are sealed by discontinuous arcuate compression seals mounted in grooves substantially parallel to the rotor peripheral faces 50. In this manner the work chambers 52 are substantially fluid sealed from one another so as to permit the intake, compression, expansion and exhaust cycles of a four-cycle engine.

In accordance with my invention continuous circular gas seal assemblies 58 and 60 are provided in circular grooves 62 and 64 machined in each of the rotor side faces 46 and 48. The grooves 62 and 64 are easily machined in a single operation thereby a necessity of three separate operations required with respect to use of the above-described discontinuous arcuate segments. Split sealing rings 66 and 68 are formed to fit within the grooves 62 and 64 and of course provide a complete seal across the rotor side faces when their respective gaps 70 and 72 are positioned out of alignment as shown in FIG. 1.

Figure 3:
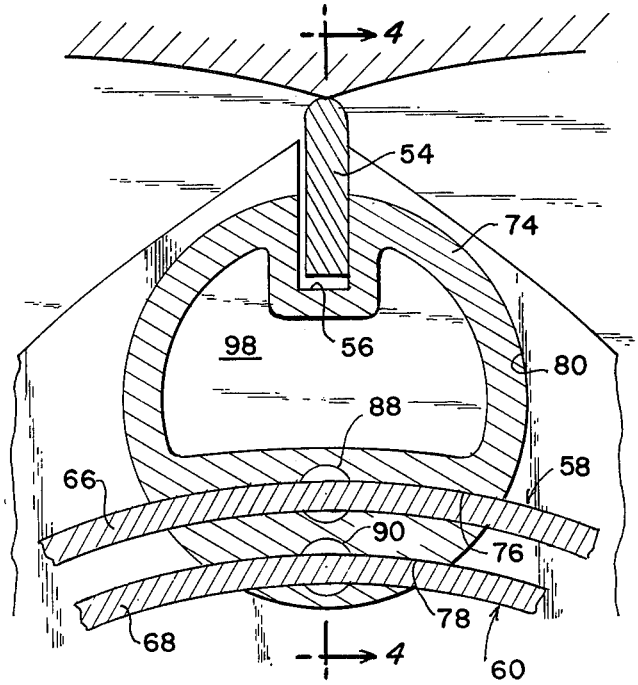
FIG. 3 is an enlarged fragmentary view, partly in section, showing the assembly relationship of an enlarged button seal with circular compression seals of the present invention.
Figure 4:
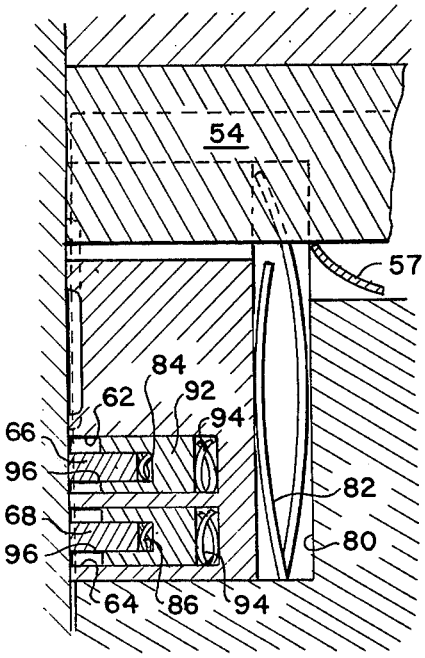
FIG. 4 is a sectional view taken alaong line 4—4 of FIG. 3.

Since the diameter of the outer sealing groove 62 is physically limited by a radius from the center of the rotor to a line tangent at the midpoint of one of the outer rotor faces 50, the path of the sealing groove 62 passes each apex at an increased distance radially inwardly thereof as compared to the path when three separate arcuate seal segments are used. Consequently, it is necessary to use enlarged corner button seal assemblies 74 engaging end walls 20 and 22 and cooperating with the apex seal 54 and the seal rings 66 and 68 for sealing each working chamber 52 from adjoining chambers as the rotor 42 rotates within cavity 24. As shown in FIGS. 3 and 4 the button seals 74 have arcuate groove segments 76 and 78 formed therein for alignment with rotor grooves 62 and 64 thereby providing a continuous circular groove capable of receiving the sealing rings. A preferred method of forming these segments includes mounting the button seals 74 in rotor recesses 80 and simultaneously forming the groove segments 76 and 78 while machining the circular grooves 62 and 64.

Figure 5:
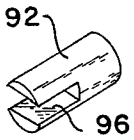
FIG. 5 is a perspective view of a plug seal slidably mounted within the enlarged button seals of my invention.

Fluid sealing of the working chambers 52 is accomplished by the apex seals 54 being continuously biased into engagement with the inner peripheral wall 14 of the rotor housing 12 by the previously described springs 57. Springs 82 are placed behind button seal 74 in recesses 80 insuring constant contact with the housing end walls 20 and 22. The sealing rings 66 and 68 are placed in the grooves 62 and 64 compressing wave springs 84 and 86 as they engage the end walls 20 and 22 so that the rings are continuously urged into engagement therewith. In order to prevent fluid leakage underneath the rings 66 and 68 and past the wave springs 84 and 86, holes 88 and 90 are provided in the button seals substantially at the midpoints of the groove segments 76 and 78. Plugs 92 are slidably received in each of the holes and are biased outwardly thereof by springs 94. The plugs are formed to contain a slot 96 snuggly receiving the rings 66 and 68, as best illustrated in FIG. 4, so that the spaces between the rings and the bottoms of the grooves 62 and 64 are sealed and fluid leakage from one working chamber 52 into another is substantially prevented. The configuration of the plugs 92 is best shown in FIG. 5. The button seals, in preferred form, contain a relieved area 98 thereby reducing the force required to obtain engagement of the button seals with engine housing end walls 20 and 22.

From the above description it is apparent that by my invention I have provided a rotor side face seal arrangement having substantial economic advantages. The machining of circular seal grooves greatly simplifies current practices and eliminates assembly procedures in that one ring replaces the usual three individual seal segments.

While I have shown and described a specific embodiment of my invention it will, of course, be understood that various modifications and alternative constructions thereof may be made without departing from the true spirit and scope of my invention and that I intend by the appended claims to cover all such modifications and alternative constructions as fall within the true spirit and scope of my invention.

I claim:

1. In a rotary machine comprising a housing having a cavity; a rotor disposed in said cavity; said rotor having a plurality of adjoining and intersecting peripheral faces and a pair of opposite side faces; an apex seal at each intersection of said peripheral faces; an output shaft rotatably supported by said housing and having an eccentric rotatably supporting said rotor; said rotor peripheral faces, said rotor side faces and said housing cooperatively defining a plurality of sealed variable volume working chambers spaced around said rotor that move with said rotor within said housing, an intake port periodically connected to said working chambers as said rotor rotates, an exhaust port periodically connected to each of said working chambers as said rotor rotates; the improvement comprising: said rotor side faces having circular seal grooves formed therein; a circular compression seal assembly mounted in each groove; a corner seal assembly at each intersection of said rotor peripheral faces, said corner seal assemblies being of substantial size and containing a segment of said circular seal grooves and said compression seal assemblies, said corner seal assemblies also containing a portion of said apex seals, and a plug seal assembly mounted in each of said corner seal circular seal groove segments in sealing relationship with each said compression seal assembly therein thereby providing a complete side seal arrangement permitting sealing of said working chambers.

2. In a rotary internal combustion engine comprising a housing including end walls and central member having a two-lobed internal peripheral surface, the end walls and said surface defining a cavity; a triangularly shaped rotor having three apices disposed in said cavity; said rotor having three peripheral faces intersecting at said apices and having a pair of opposite side faces facing said housing end walls; an apex seal mounted in an axial groove in said rotor at each apex; an output shaft rotatably supported by said housing and having an eccentric rotatably supporting said rotor; said rotor peripheral faces, said rotor side faces and said housing end walls cooperatively defining a plurality of sealed variable volume working chambers spaced around said rotor and moving with said rotor as it rotates within said cavity; intake and exhaust ports in said housing periodically connected to each of said working chambers as said rotor rotates; the improvement comprising: said rotor side faces having circular seal grooves formed therein; a spring positioned in the bottom of each seal groove; a circular seal ring positioned in each of said seal grooves and being biased outwardly of said rotor side faces by said springs forming compression seals; a circular corner button seal positioned in a like recess in said rotor side face at each rotor apex, said recess being sufficiently large in diameter to intersect the path of said circular seal grooves and said apex seal grooves at each rotor apex; said button seal containing a segment of said circular seal grooves, and a plug seal assembly mounted in each of said button seal circular seal groove segments in sealing relationship with each said seal ring therein whereby said apex seals, said button seals, said plug seal assemblies and said circular side compression seals complete a rotor side seal arrangement permitting sealing of said working chambers.

3. In a rotary internal combustion engine comprising a housing including end walls and central member having a two-lobed internal peripheral surface, the end walls and said surface defining a cavity; a triangularly shaped rotor having three apices disposed in said cavity; said rotor having three peripheral faces intersecting at said apices and having a pair of opposite side faces facing said housing end walls; an apex seal mounted in an axial groove in said rotor at each apex; an output shaft rotatably supported by said housing and having an eccentric rotatably supporting said rotor; said rotor peripheral faces, said rotor side faces and said housing end walls cooperatively defining a plurality of sealed variable volume working chambers spaced around said rotor and moving with said rotor as it rotates within said cavity; intake and exhaust ports in said housing periodically connected to each of said working chambers as said rotor rotates; the improvement comprising: said rotor side faces having circular seal grooves formed therein; a circular wave spring mounted in each groove; a circular compression seal ring mounted in each groove upon said wave springs and being biased outwardly of said grooves thereby; said rotor having cylindrical recesses in said side faces adjacent each apex; said cylindrical recesses being of sufficient diameter to extend across said seal grooves and said apex seal grooves; a corner button spring mounted in each of said recesses; a corner button seal mounted in each of said cylindrical recesses upon said springs and being biased outwardly of said cylindrical recesses thereby for continual engagement with said housing end walls; said button seals each containing a segment of said circular seal grooves and having a recessed area in their outer faces reducing the force required to obtain the continual engagement with said housing end walls; said button seals containing a plug seal cylindrical hole in each of said seal groove segments; a spring disposed in the bottom of each of said plug seal holes; and a plug seal slidably received in each of said holes and each containing a groove receiving respective seal rings providing a seal underneath said rings; said button seals providing a closed sealed path from said circular seal rings outwardly across said button seals to said apex seals thereby fluid sealing each working chamber from its adjoining chambers.

* * * * *

UNITED STATES PATENT AND TRADEMARK OFFICE

CERTIFICATE OF CORRECTION

PATENT NO. : 3,930,767

DATED : January 6, 1976

INVENTOR(S) : Jack A. Hart

It is certified that error appears in the above-identified patent and that said Letters Patent are hereby corrected as shown below:

Column 2, line 23, "alaong" should read -- along --.
Column 3, line 17, after "thereby" insert -- avoiding --.

Signed and Sealed this

*twenty-seventh* Day of *April 1976*

[SEAL]

*Attest:*

RUTH C. MASON
*Attesting Officer*

C. MARSHALL DANN
*Commissioner of Patents and Trademarks*